United States Patent [19]

Lowry

[11] 4,435,310

[45] Mar. 6, 1984

[54] MANUFACTURE OF MULTICOLORED DETERGENT BARS HAVING SINUSOIDAL STRIPING

[75] Inventor: Michael R. Lowry, Chester, England

[73] Assignee: Lever Brothers Company, New York, N.Y.

[21] Appl. No.: 321,854

[22] Filed: Nov. 16, 1981

Related U.S. Application Data

[63] Continuation of Ser. No. 195,209, Oct. 17, 1980, abandoned, which is a continuation of Ser. No. 12,619, Feb. 16, 1979, abandoned.

[30] Foreign Application Priority Data

Feb. 20, 1978 [GB] United Kingdom ..... 6653/78

[51] Int. Cl.[3] ..... C11D 9/44; C11D 13/08; C11D 13/18; C11D 17/00

[52] U.S. Cl. ..... 252/370; 252/92; 252/134; 252/174; 252/368; 252/DIG. 16; 264/75; 264/103; 264/148; 264/151

[58] Field of Search ..... 252/92, 134, 174, DIG. 16, 252/368, 370; 264/75, 103, 148, 151, 210 R, 245, 320; 425/319, 320, 321, 232

[56] References Cited

U.S. PATENT DOCUMENTS

| | | | |
|---|---|---|---|
| 3,180,912 | 4/1965 | Rowe | 264/75 X |
| 3,899,566 | 8/1975 | Murray | D28/8.1 |
| 4,041,119 | 8/1977 | Fischer | 264/75 |

FOREIGN PATENT DOCUMENTS

| | | |
|---|---|---|
| 2292764 | 6/1976 | France . |
| 1148273 | 4/1969 | United Kingdom . |
| 1326258 | 8/1973 | United Kingdom . |
| 1387601 | 3/1975 | United Kingdom . |
| 1387567 | 3/1975 | United Kingdom . |
| 1437323 | 5/1976 | United Kingdom . |

*Primary Examiner*—Dennis L. Albrecht

*Attorney, Agent, or Firm*—Amirali Y. Haidri; James J. Farrell

[57] ABSTRACT

Striped detergent bars can be manufactured by several methods. The application of torque to a striped extruded log provides a bar with a spiral striping. The present invention proposes reversal of torque so that a sinusoidal striping is present on the bar.

4 Claims, 3 Drawing Figures

MANUFACTURE OF MULTICOLORED DETERGENT BARS HAVING SINUSOIDAL STRIPING

Figure 1:
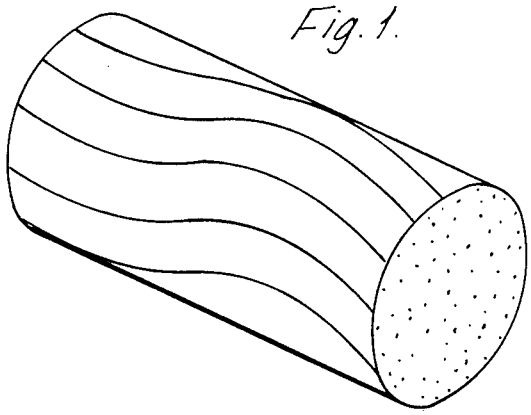

This application is a continuation of application Ser. No. 195,209 filed on Oct. 17, 1980 and now abandoned which was a continuation of application Ser. No. 012,619 filed on Feb. 16, 1979 and now abandoned.

This invention relates to multi-coloured detergent bars and, in particular, to bars having stripes of material with an appearance different from the base material. These stripes will be present at least on the surface of the bar.

The production of detergent bars having appearance contrasting stripes is well documented in the patent and commercial literature; products having stripes have been commercially available in a number of countries.

Published methods for producing striping, which is also termed striating and marbling, include:

(i) mixing batches of soap chips having different appearance and plodding the mixture; an example of the method is described in British patent specification No. 1326258, (ii) injecting a liquid or pasty colourant material at a specified point in the plodding process; examples of this process are described in British 1148273, French 1600543 and British 1387567 patent documents, and (iii) extruding two streams of detergent material into a compression cone to form an extruded log; an example of this process is described in British patent document 1387601.

The present invention is applicable to striped detergent bars formed by any of the known methods and is directed to processing applied to the extruded log.

The invention proposes a method of manufacturing detergent bars having curved surface striping wherein a continuous log of a longitudinally striped detergent mass is extruded from a nozzle and the log is twisted by being subjected to torque at a station spaced from the nozzle with subsequent cutting into billets and stamping to form bars, characterised in that the torque is reversed to provide a reversing spiral striping on the log and at least about a quarter of a cycle of the reversing spiral along the bar length. Preferably at least about half a cycle and more preferably at least about one cycle of the reversing spiral striping is present on the bar surface. When at least about half a cycle is present the curved striping will exhibit one point at which the spiral striping changes direction of curvature. The preferred sectional shape of the extruded log is circular. An extruded log of circular section allows the application of torque in a simple and uniform manner. Additionally a circular billet only requires positioning on the desired line in the stamping die; billets of less symmetrical section, e.g. square, require rotation to a desired presentation.

A preferred method is to apply the reversing torque without a rest period between the periods when torque is applied. Omission of a rest period provides a continuously curving stripe of substantially sinusoidal appearance. When a rest period is present in the method, the stripes have a portion parallel to the direction of extrusion between curving portions.

The periods during which torque is applied are chosen relative to the rate of extrusion and the length of the bar manufactured to give the desired fractional or complete cycles on the bar.

The application of the process according to this invention provides a detergent bar with an enhanced visual appearance. The stamping of a striped billet will usually cause some distortion of the striping at the line or surface forming the bar edge. When a billet prepared by the present method is stamped in alignment, that is positioned on the centre line of the die box, the edge striping is not distorted and forms a continuous pattern with the surface striping.

The invention extends to detergent bars having a substantially sinusoidal striping on the bar surface with at least about one quarter of a cycle on an axis parallel to the longitudinal axis of the bar. Preferably at least about one half a cycle is present and, more preferably, at least about one cycle. Preferably the substantially sinusoidal striping is continuous, that is it has been manufactured without a rest period in the application of torque.

The billet will normally be longitudinally stamped but use of skew stamping, when the billet is rotated through an angle in the plane of the dies, will also provide attractive surface markings.

A proposal to twist a striped extruded billet to give a spiral appearance is present in British patent document 1387567, and U.S. Pat. No. 4,041,119 contains a description of an apparatus to achieve the spiral form of striping.

The disclosures in British 1387567 and U.S. Pat. No. 4,041,119 are incorporated herein by reference.

In the accompanying diagrammatic drawing the following specimens are illustrated:

FIG. 1 Circular section extruded log with sinusoidal striping.

Figure 2:
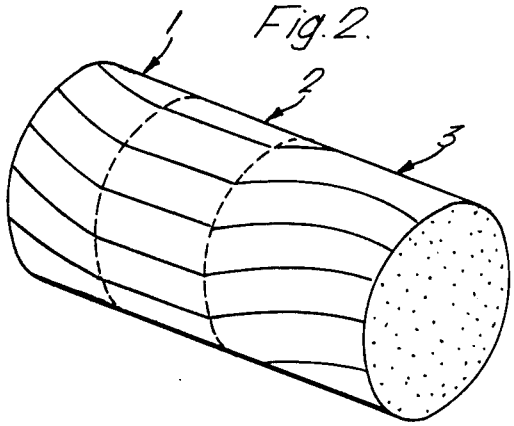

FIG. 2 Circular section extruded log with rest period corresponding to zone 2 between reversed torque periods corresponding to zones 1 and 3.

Figure 3:
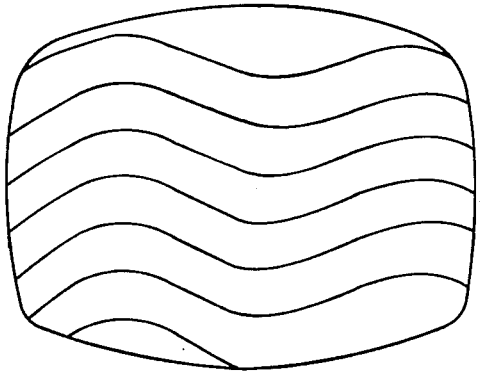

FIG. 3 Stamped bar with about one cycle of sinusoidal striping viewed from directly above a major face.

An example of the method of the invention will now be given together with a description of the visual appearances achievable.

A striped soap log was manufactured using the process described in UK patent document No. 1387567. A light green soap base prepared from a feedstock comprising tallow and coconut fatty acids was extruded from a plodder including a multiapertured plate positioned immediately following the extruder screw. A liquid colourant containing a suspended dark green dye was injected at one point between the apertures in the plate on the downstream face between the separate rods of soap. The striped extruded log was manually twisted as it exited through the extrusion nozzle. The torque applied was reversed after a period to give a reversed spiral appearance to the stamped bar. The period of torque application before reversal was selected to give about one cycle of sinusoidal striping on the bar surface.

I claim:

1. A method of manufacturing detergent bars having curved surface striping wherein a continuous log of a longitudinally striped detergent mass is extruded from a nozzle and the log is subjected to torque about the longitudinal axis at a station spaced from the nozzle with subsequent cutting into billets and stamping to form bars, characterized in that the torque is reversed to provide a reversing spiral striping on the log and at least a half of a cycle of striping of substantially sinusoidal form along the longitudinal axis of the bar.

2. A method according to claim 1 wherein the bar manufactured has at least one cycle on the surface.

3. A method according to claim 1 wherein the sectional shape of the extruded log is circular.

4. A method according to claim 1 wherein there is no rest period between the periods when torque is reversed.

* * * * *